US010196917B2

(12) United States Patent
Lutjen et al.

(10) Patent No.: US 10,196,917 B2
(45) **Date of Patent: *Feb. 5, 2019**

(54) BLADE OUTER AIR SEAL WITH CORED PASSAGES

(71) Applicant: United Technologies Corporation, Hartford, CT (US)

(72) Inventors: Paul M. Lutjen, Kennebunkport, ME (US); Shawn J. Gregg, Wethersfield, CT (US); Thurman Carlo Dabbs, Dover, NH (US); Ken F. Blaney, Middleton, NH (US); Russell E. Keene, Arundel, ME (US); Bruce E. Chick, Strafford, NH (US)

(73) Assignee: United Technologies Corporation, Hartford, CT (US)

( * ) Notice: Subject to any disclaimer, the term of this patent is extended or adjusted under 35 U.S.C. 154(b) by 406 days.

This patent is subject to a terminal disclaimer.

(21) Appl. No.: 14/789,232

(22) Filed: Jul. 1, 2015

(65) Prior Publication Data

US 2015/0300195 A1 Oct. 22, 2015

Related U.S. Application Data

(63) Continuation of application No. 13/487,360, filed on Jun. 4, 2012, now Pat. No. 9,103,225.

(51) Int. Cl.
*F01D 11/08* (2006.01)
*F01D 25/12* (2006.01)
(Continued)

(52) U.S. Cl.
CPC ..... *F01D 11/08* (2013.01); *F01D 1/02* (2013.01); *F01D 11/24* (2013.01); *F01D 25/12* (2013.01);
(Continued)

(58) Field of Classification Search
CPC ..... F01D 11/08; F01D 11/24; F01D 25/12; F01D 9/06; F01D 9/065; F05D 2260/205;
(Continued)

(56) References Cited

U.S. PATENT DOCUMENTS 4,392,656 A 7/1983 Tirole et al.
4,551,064 A * 11/1985 Pask ..... F01D 11/08 415/115
(Continued)

FOREIGN PATENT DOCUMENTS

EP 0694677 A1 1/1996
EP 0709550 A1 5/1996
(Continued)

OTHER PUBLICATIONS

The International Search Report dated Mar. 19, 2014 for International Application No. PCT/US2013/044032.
(Continued)

*Primary Examiner* — Christopher Verdier
(74) *Attorney, Agent, or Firm* — Kinney & Lange, P.A.

(57) ABSTRACT

A blade outer air seal for a gas turbine engine includes a wall, a forward hook, and an aft hook. The wall extends between the forward hook and the aft hook, which are adapted to mount the blade outer air seal to a casing of the gas turbine engine. The wall includes a cored passage extending along at least a portion of the wall. The cored passage extends radially and axially through a portion of the aft hook to communicate with one or more apertures along a trailing edge of the aft hook.

20 Claims, 5 Drawing Sheets

(51) Int. Cl.
*F01D 1/02* (2006.01)
*F01D 11/24* (2006.01)

(52) U.S. Cl.
CPC ..... *F05D 2220/32* (2013.01); *F05D 2240/11* (2013.01); *F05D 2260/20* (2013.01); *F05D 2260/201* (2013.01); *F05D 2260/205* (2013.01); *F05D 2260/2212* (2013.01); *F05D 2260/2214* (2013.01)

(58) Field of Classification Search
CPC ..... F05D 2260/2212; F05D 2260/2214; F05D 2260/22141; F05D 2240/11; F05D 2260/20; F05D 2260/201; F05D 2260/202
USPC ..... 415/173.1, 173.2, 173.4, 115–116
See application file for complete search history.

(56) References Cited

U.S. PATENT DOCUMENTS 4,573,865 A * 3/1986 Hsia ..... F01D 5/187 165/109.1
4,642,024 A * 2/1987 Weidner ..... F01D 11/08 415/116
4,752,184 A * 6/1988 Liang ..... F01D 9/04 415/116
5,423,659 A * 6/1995 Thompson ..... F01D 25/246 415/139
5,498,126 A * 3/1996 Pighetti ..... F01D 5/187 415/115
5,993,150 A 11/1999 Liotta et al.
6,126,389 A * 10/2000 Burdgick ..... F01D 11/24 415/115
6,779,597 B2 * 8/2004 DeMarche ..... F01D 11/24 165/169
6,899,518 B2 5/2005 Lucas et al.
7,334,985 B2 * 2/2008 Lutjen ..... F01D 11/24 415/173.1
7,650,926 B2 1/2010 Tholen
7,665,953 B2 * 2/2010 Lee ..... F01D 11/24 415/1
7,686,068 B2 3/2010 Tholen et al.
7,704,039 B1 4/2010 Liang
8,128,344 B2 * 3/2012 McGovern ..... F01D 11/08 415/116
8,974,174 B2 * 3/2015 Khanin ..... F01D 9/00 415/115
9,103,225 B2 * 8/2015 Lutjen ..... F01D 11/08
2003/0035722 A1 * 2/2003 Barrett ..... F01D 9/04 415/200
2006/0140753 A1 6/2006 Romanov et al.
2009/0123266 A1 5/2009 Thibodeau et al.
2011/0044802 A1 2/2011 Di Paola et al.
2011/0236188 A1 9/2011 Knapp et al.
2012/0057968 A1 * 3/2012 Lee ..... F01D 11/08 415/178
2014/0286751 A1 * 9/2014 Brunelli ..... F01D 11/24 415/116

FOREIGN PATENT DOCUMENTS

EP 1176285 A2 1/2002
EP 1676981 A2 7/2006
EP 1905951 A2 4/2008
FR 2954401 A1 6/2011
WO 9412775 A1 6/1994

OTHER PUBLICATIONS

European Examination Report for EP Application No. 13829503.5, dated Jul. 31, 2018, 6 pages.

* cited by examiner

BLADE OUTER AIR SEAL WITH CORED PASSAGES

CROSS-REFERENCE TO RELATED APPLICATION(S)

This application is a continuation of U.S. Pat. No. 9,103,225, entitled "BLADE OUTER AIR SEAL WITH CORED PASSAGES", filed Jun. 4, 2012.

BACKGROUND

The invention relates to gas turbine engines, and more particularly to blade outer air seals (BOAS) for gas turbine engines.

A gas turbine engine ignites compressed air and fuel to create a flow of hot combustion gases to drive multiple stages of turbine blades. The turbine blades extract energy from the flow of hot combustion gases to drive a rotor. The turbine rotor drives a fan to provide thrust and drives a compressor to provide a flow of compressed air. Vanes interspersed between the multiple stages of turbine blades align the flow of hot combustion gases for an efficient attack angle on the turbine blades.

The BOAS as well as turbine vanes are exposed to high-temperature combustion gases and must be cooled to extend their useful lives. Cooling air is typically taken from the flow of compressed air. Therefore, some of the energy extracted from the flow of combustion gases must be expended to provide the compressed air used to cool the BOAS as well as the turbine vanes. Energy expended on compressing air used for cooling the BOAS and turbine vanes is not available to produce thrust. Improvements in the efficient use of compressed air for cooling the BOAS and turbine vanes can improve the overall efficiency of the turbine engine.

SUMMARY

A blade outer air seal for a gas turbine engine includes a first wall disposed radially inward from a casing of the gas turbine engine and a second wall disposed radially inward from the casing and adjacent to the first wall. The first wall at least partially defines a first plenum between the casing and the first wall. The second wall at least partially defines a second plenum. The first wall includes a forward hook and an aft hook adapted to mount the blade outer air seal to the casing. The first wall further includes a plurality of cored passages and a plurality of apertures along a trailing edge of the blade outer air seal. The cored passages communicate with the first plenum and at least one of the apertures to form a flow path therebetween, and each aperture communicates with the second plenum. Furthermore, each cored passage extends radially and axially through at least a portion of the first wall and is enclosed by the first wall for a substantial length of the cored passage.

A method of cooling a blade outer air seal includes supplying a cooling medium to a first plenum disposed between a blade outer air seal and an engine casing and directing the cooling medium through one or more cored passages within the blade outer air seal to cool the blade outer air seal. The method further includes directing the cooling medium from the one or more cored passages to a stator vane and directing the cooling medium to a second plenum that is at least partially defined by an outer platform of the stator vane.

A gas turbine engine includes an engine casing and a turbine section. The turbine section includes a rotor blade disposed radially inward of the engine casing with respect to a centerline axis of the gas turbine engine, a blade outer air seal, and a stator vane disposed axially aft of the rotor blade. The blade outer air seal has a wall disposed radially inward from the engine casing that at least partially defines a first plenum between the engine casing and the wall. The wall includes a forward hook, an aft hook, a cored passage, and an aperture. The forward and aft hooks are adapted to mount the blade outer air seal to the engine casing. The cored passages extend radially and axially through at least a portion of the wall such that the cored passage is enclosed by the wall for a substantial length thereof. The aperture is disposed along a trailing edge of the blade outer air seal such that the cored passage communicates with the first plenum and the aperture to form a flow path therebetween. The stator vane includes an outer platform disposed radially inward from the engine casing and adjacent to the wall to at least partially define a second plenum such that the aperture communicates with the second plenum to allow the flow path to communicate with the stator vane.

DISCUSSION OF POSSIBLE EMBODIMENTS

In other embodiments BOAS, turbine section and gas turbine engine can include one or more of the following components or features. In one embodiment, the cored passage includes a crossover passage that communicates through one or more inlets at an outer diameter surface of an in-line portion of the cored passage. The inlet of the one or more crossover passages is located where the coring minimizes impact to life capability, specifically low cycle fatigue. The one or more crossover passages communicate with a plenum which extends laterally through the aft hook, and wherein the plenum communicates with the one or more apertures disposed along the trailing edge of the aft hook.

In one embodiment, the cored passage extends substantially an entire length of the wall from adjacent the forward hook to the aft hook. The cored passage has at least one of a convective zone and an impingement zone. The impingement zone includes at least one of a plurality of radially extending passages through the wall and a cover plate with a plurality of radially extending holes therethrough. The cored passage has a convective zone that has at least one of an augmentation surface and a flow turbulator feature. The flow turbulator feature comprises a sinuously curved section of the cored passage.

In one embodiment, the cored passage communicates with a cored cavity within the wall between the forward hook and the aft hook. An impingement zone or augmentation surface is disposed within the cored cavity.

In one embodiment a stator vane is disposed axially aft of the rotor blade and one or more conformal seals are disposed between the trailing edge of the blade outer air seal and the stator vane. The one or more apertures that communicate with the cored passage are disposed radially outward of the conformal seals with respect to the centerline axis of the gas turbine engine.

DETAILED DESCRIPTION

The present invention provides a BOAS design with higher convective efficiency. More particularly, the various embodiments of the BOAS described herein utilize cored cooling air flow passages to better control cooling air flow and improve the heat transfer coefficient for the BOAS, thereby improving the operational longevity of the BOAS. Additionally, the cored passages of the BOAS are adapted to feed cooling air to a stator vane for reuse to allow the vane to meet cooling requirements. Thus, the cored passages decrease the use of less efficient higher pressure cooling air and improve the efficiency of the gas turbine engine. By having a geometry capable of passing cooling air to the stator vanes around various other components of the gas turbine engine, the cored passages allow for components such as a conformal seal (w-seal) to be disposed adjacent the BOAS. Utilizing a conformal rather than a chordal seal allows for further improvements in gas turbine engine efficiency.

Figure 1:
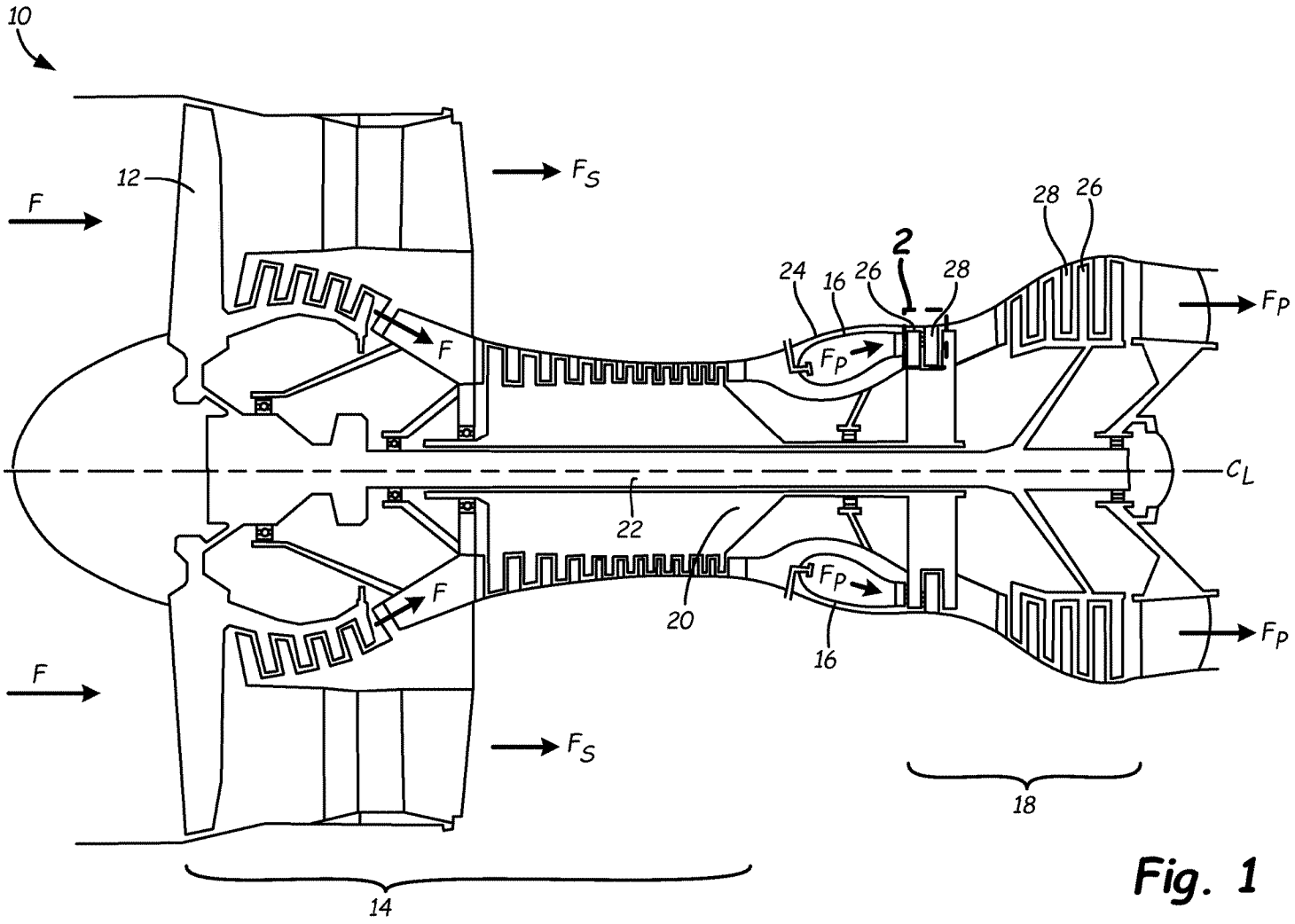
FIG. 1 is a sectional view of a gas turbine engine.

FIG. 1 is a representative illustration of a gas turbine engine 10 including a BOAS with cored cooling air flow passages therein. The view in FIG. 1 is a longitudinal sectional view along an engine center line. FIG. 1 shows gas turbine engine 10 including fan 12, compressor 14, combustor 16, turbine 18, high-pressure rotor 20, low-pressure rotor 22, and engine casing 24. Turbine 18 includes rotor stages 26 and stator stages 28.

As illustrated in FIG. 1, fan 12 is positioned along engine center line $C_L$ at one end of gas turbine engine 10. Compressor 14 is adjacent fan 12 along engine center line $C_L$, followed by combustor 16. Turbine 18 is located adjacent combustor 16, opposite compressor 14. High-pressure rotor 20 and low-pressure rotor 22 are mounted for rotation about engine center line $C_L$. High-pressure rotor 20 connects a high-pressure section of turbine 18 to compressor 14. Low-pressure rotor 22 connects a low-pressure section of turbine 18 to fan 12. Rotor stages 26 and stator stages 28 are arranged throughout turbine 18 in alternating rows. Rotor stages 26 connect to high-pressure rotor 20 and low-pressure rotor 22. Engine casing 24 surrounds turbine engine 10 providing structural support for compressor 14, combustor 16, and turbine 18, as well as containment for cooling air flow, as described below.

In operation, air flow F enters compressor 14 through fan 12. Air flow F is compressed by the rotation of compressor 14 driven by high-pressure rotor 20. The compressed air from compressor 14 is divided, with a portion going to combustor 16, and a portion employed for cooling components exposed to high-temperature combustion gases, such as BOAS and stator vanes, as described below. Compressed air and fuel are mixed and ignited in combustor 16 to produce high-temperature, high-pressure combustion gases Fp. Combustion gases Fp exit combustor 16 into turbine section 18. Stator stages 28 properly align the flow of combustion gases Fp for an efficient attack angle on subsequent rotor stages 26. The flow of combustion gases Fp past rotor stages 26 drives rotation of both high-pressure rotor 20 and low-pressure rotor 22. High-pressure rotor 20 drives a high-pressure portion of compressor 14, as noted above, and low-pressure rotor 22 drives fan 12 to produce thrust Fs from gas turbine engine 10. Although embodiments of the present invention are illustrated for a turbofan gas turbine engine for aviation use, it is understood that the present invention applies to other aviation gas turbine engines and to industrial gas turbine engines as well.

Figure 2:
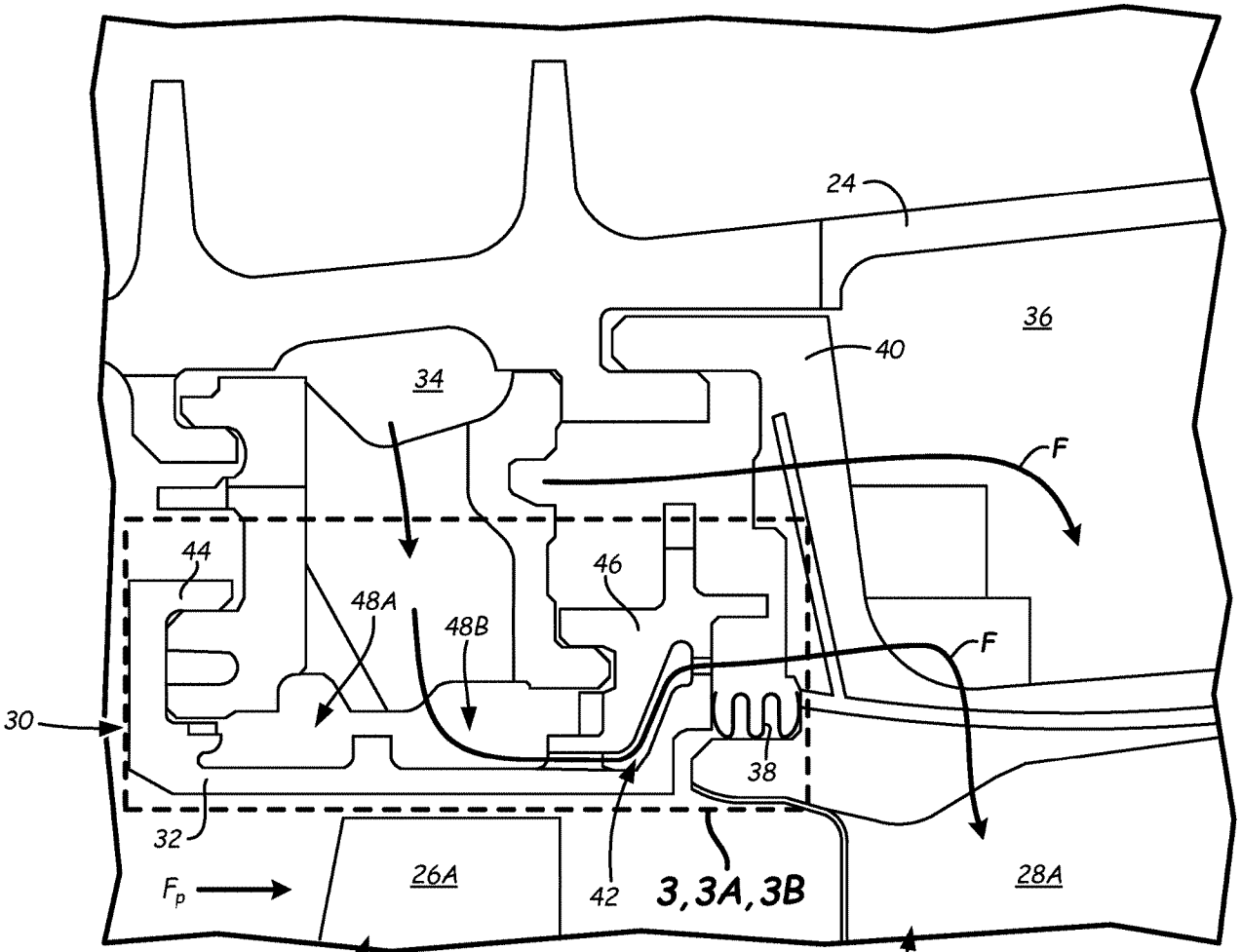
FIG. 2 is an enlarged view of a turbine portion of the gas turbine engine shown in FIG. 1 with a BOAS having internal cored passages and cored cavities.

FIG. 2 is an enlarged view of a high pressure turbine portion of the gas turbine engine shown in FIG. 1 with the blade outer air seal (BOAS) disposed axially forward of the turbine vane airfoil. FIG. 2 illustrates rotor stage 26, stator stage 28, BOAS 30, first plenum 34, second plenum 36, and conformal seal 38. BOAS 30 includes a wall 32, cored passages 42 (only one is shown in FIG. 2), forward hook 44, aft hook 46, and forward and aft cored cavities 48A and 48B.

Rotor blade 26A comprises a single blade in rotor stage 26 disposed downstream of combustor 16 (FIG. 1). Rotor stage 26 extends in a circumferential direction about engine center line CL and has a plurality of rotor blades 26A. During operation, combustion gases Fp pass between adjacent rotor blades 26A and pass downstream to stator vanes 28A. Rotor blade 26A is disposed radially inward of BOAS 30, with respect to engine center line CL as shown in FIG. 1.

Stator vane 28A is disposed axially rearward of BOAS 30 and comprises a portion of stator stage 28. Like rotor stage 26, stator stage 28 extends in a circumferential direction about engine center line CL and has a plurality of stator vanes 28A. During operation, combustion gases Fp pass between adjacent stator vanes 28A. Although not shown in FIG. 2, stator vane 28A includes several internal cooling channels. Stator vane 28A includes an OD platform 40 with a mounting hook feature that allows stator vane 28A to be mounted to engine case 24.

BOAS 30 comprises an arcuate segment with an ID portion of wall 32 forming the OD of the engine flowpath through which combustion gases Fp pass. As will be discussed subsequently, cored passages 42 extend through at least a portion of wall 32 radially outward of the engine flowpath. BOAS 30 is mounted to engine case 24 by forward hook 44 and aft hook 46. In the embodiment shown, wall 32 includes forward and aft cored cavities 48A and 48B. Aft cavity 48B communicates with cored passage 42, which extends aftward through wall 32 and aft hook 46 to adjacent conformal seal 38. Conformal seal 38 (w-seal) is disposed between BOAS 30 and OD vane platform 40.

First plenum 34 is a cooling air source radially outward from BOAS 30 and bounded in part by engine casing 24. Cooling air is supplied to first plenum 34 from a high-pressure stage of compressor 14 (FIG. 1). Second plenum 36 is a cooling air source radially outward from stator vane 28A and bounded in part by engine casing 24. Cooling air is supplied to second plenum 36 from an intermediate-pressure stage of compressor 14. Thus, cooling air supplied by first plenum 34 is at a pressure higher than the cooling air supplied by second plenum 36. As shown in FIG. 2, second plenum 36 is also bounded by OD vane platform 40, which along with BOAS 30, separates first plenum 34 from second plenum 36 to maintain the pressure difference therebetween. Vane 28A receives air from plenums 34, 36 as well as BOAS passage 42.

BOAS 30 is cast via an investment casting process. In an exemplary casting process, a ceramic casting core is used to form cored passages 42. The ceramic casting core has a geometry which shapes cored passages 42. The ceramic casting core is placed in a die. Wax is molded in the die over the core to form a desired pattern. The pattern is shelled (e.g., a stuccoing process to form a ceramic shell). The wax is removed from the shell. Metal alloy is cast in the shell over the ceramic casting core. The shell and ceramic casting core are destructively removed. After ceramic casting core removal, the cored passages 42 are left in the resulting raw BOAS casting. Cored passages 42 can have complex and varied geometry compared to prior art drilled passages. Varied geometry allows cored passages 42 to feed cooling airflow around other engine components such as conformal seal 38 disposed between the BOAS 30 and stator vane 28A. Utilizing a conformal rather than a chordal seal allows for further improvements in gas turbine engine efficiency. Additionally, cored passages 42 offer better capability to control cooling air flow and improve the heat transfer coefficient for BOAS 30, improving the longevity of BOAS 30. In other embodiments, cored passages 42 can be formed using other known methods including the use of refractory metal cores. Refractory metal cores can be used to eliminate the use of ceramic from the manufacturing process in favor of select metal alloys.

In operation, as the flow of combustion gases Fp passes through rotor blades 26A between a blade platform (not shown) and BOAS 30 the flow of combustion gases Fp impinges upon rotor blade 26A causing rotor stage 26 to rotate about engine center line CL. BOAS 30 is mounted just radially outward from rotor blade 26A tip and provides a seal against combustion gases Fp radially bypassing rotor blade 26A. The flow of combustion gases Fp exits rotor stage 26 and enters stator vane stage 28, where it is channeled between vane ID platform (not shown) and vane OD platform 40. Within stator stage 28, the flow of combustion gases impinges upon vane 28A and is aligned for a subsequent rotor stage (not shown).

In this embodiment of the present invention, cooling air flow F passes from first plenum 34 through BOAS 30. Cooling air flow F provides desired cooling in order to increase the operational life of BOAS 30. Cored passages 42 allow cooling air flow F to pass through BOAS 30 and direct cooling air flow F around conformal seal 38. Eventually, cooling air flow F can pass to second plenum 36 where it is mixed and/or cooling air flow F can pass directly to separate flow circuits that extend through stator vane 28A.

Figure 3:
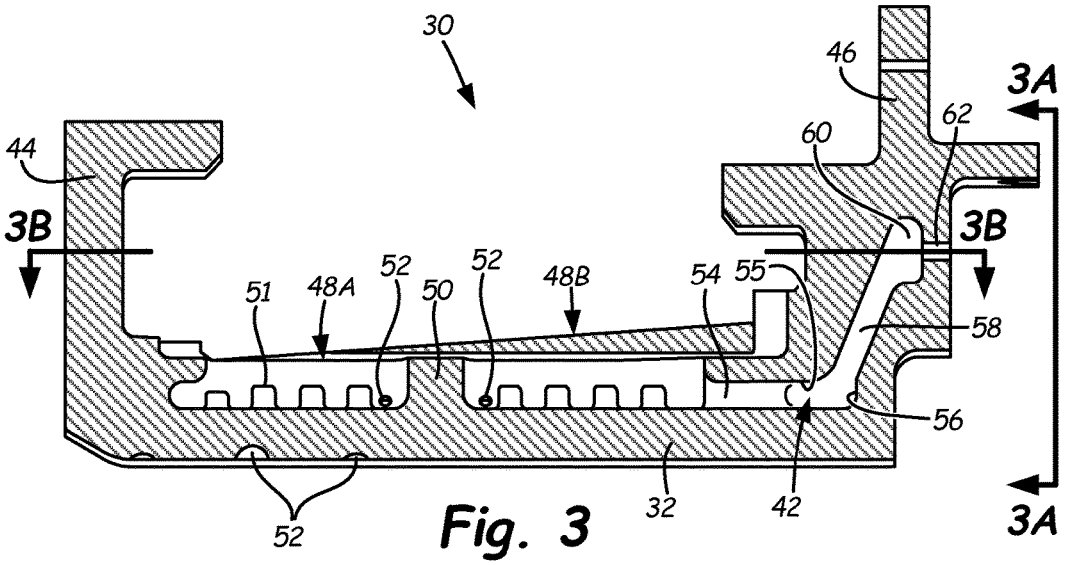
FIG. 3 is a cross-section extending radially through BOAS of FIG. 2.

FIG. 3 shows a cross-section extending radially through BOAS 30 with respect to engine center line $C_L$ (FIG. 1). In addition to wall 32, cored passages 42 (only one is shown in the section of FIG. 3), forward hook 44, aft hook 46, and forward and aft cored cavities 48A and 48B, BOAS 30 includes a rib 50, augmentation features 51, and lateral film cooling holes 52. Each cored passage 42 includes in-line portion 54 with outer diameter surface 55, trailing edge face 56, crossover passage 58, plenum 60, and apertures 62.

Cavities 48A and 48B are formed in wall 32 and are separated by laterally extending rib 50. As shown in FIG. 3, forward cavity 48A is disposed adjacent forward hook 44 while aft cavity 48B is disposed adjacent aft hook 46. In the embodiment shown, augmentation features 51 are disposed within cavities 48A and 48B. Lateral film cooling holes 52 extend from cavities 48A and 48B through wall 32 to engine flow path Fp (FIG. 2).

Aft cavity 48B communicates with cored passages 42. Cored passages 42 extend from aft cavity 48B along wall 32 and through aft hook 46 to trailing edge of BOAS 30. More particularly, each cored passage 42 has in-line portion 54 that extends generally axially rearward from aft cavity 48B through wall 32. In-line portion 54 terminates at trailing edge face 56.

Outer diameter surface 55 of in-line portion 54 is the location of one or more inlets to each crossover passage 58. Thus, crossover passages 58 do not extend from trailing edge face 56. Crossover passages 58 extend through aft hook 46 to plenum 60. Plenum 60 extends laterally through aft hook 46 and communicates with several crossover passages 58 in one embodiment. Plenum 60 has an outlet to the trailing edge of BOAS 30 through apertures 62.

In operation, cooling air flow enters forward and aft cored cavities 48A and 48B and can pass through an impingement zone (not shown in FIG. 3) such as a cover plate with a plurality of radially extending holes therethrough. Cooling air flow contacts augmentation feature 51, which provides for additional heat transfer capability. Air flow passes through lateral film cooling holes 52 and cored passages 42 out of BOAS 30. In passing through cored passages 42, cooling air flow passes through in-line portion 54 to apertures 62. The inlet of the one or more crossover passages 58 is located where the coring minimizes impact to life capability, specifically low cycle fatigue. By placing the inlet to crossover passages 58 at outer diameter surface 55, low cycle fatigue is reduced and the operational longevity of BOAS 30 is improved.

Cooling air flow passes through inlet(s) into crossover passages 58. Crossover passages 58 extend radially as well as axially through aft hook 46 to allow cooling air flow to be transported around conformal seal 38 (FIG. 2). Because cored passages 42 allow for variable geometry passages a more robust seal is accommodated within gas turbine engine 10 (FIG. 1).

From plenum 60 cooling air flow is discharged from the trailing edge of BOAS 30 through one or more apertures 62. Apertures 62 can be formed by a coring process or by traditional forms of machining.

Figure 3A:
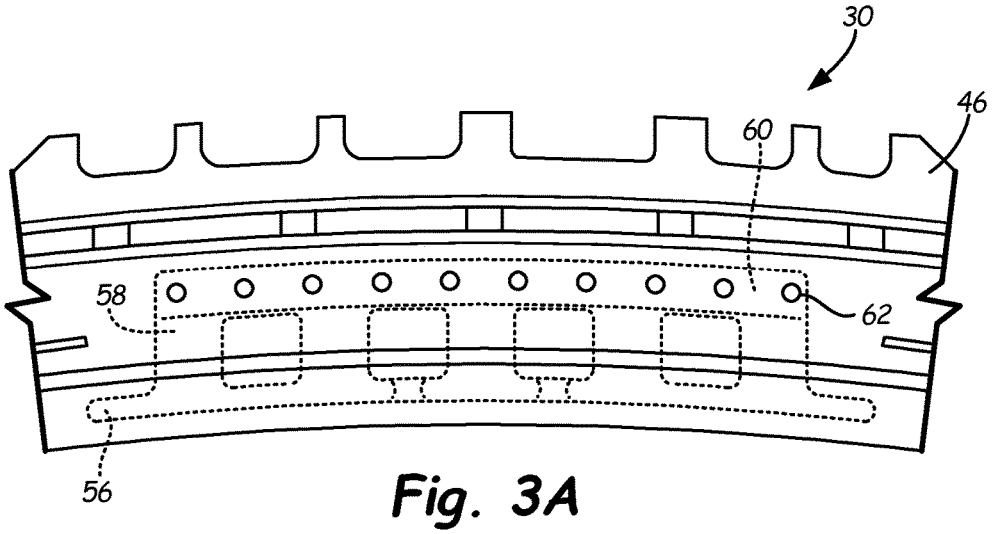
FIG. 3A is a rear view of a trailing edge surface of the BOAS of FIG. 3 with portions of the cored passages shown in phantom.

FIG. 3A shows a trailing edge surface of BOAS 30 immediately rearward of aft hook 46. Plenum 60, crossover passages 58, and trailing edge face 56 are shown in phantom in FIG. 3A. As shown in FIG. 3A, plenum 60 extends laterally between crossover passages 58 and communicates with apertures 62 in the trailing edge of BOAS 30.

Figure 3B:
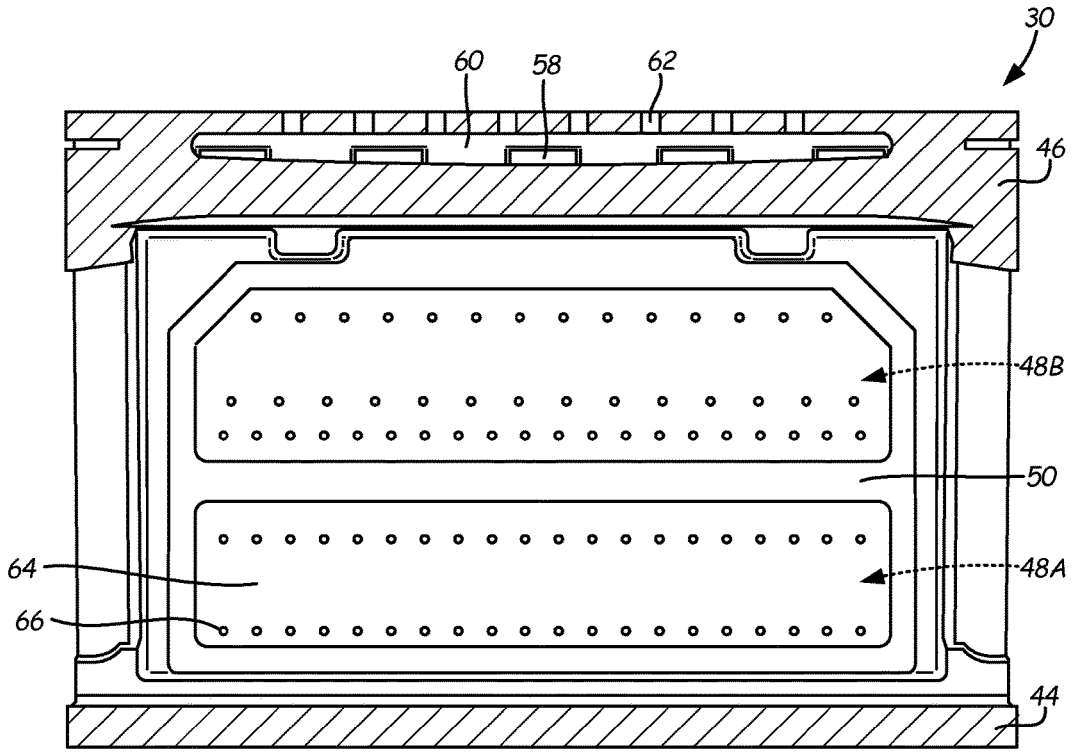
FIG. 3B is a top partial sectional view of another embodiment of a BOAS with an impingement plate covering cored cavities.

FIG. 3B shows a top partial sectional view of BOAS 30 which illustrates various components previously discussed including forward hook 44, aft hook 46, rib 50, crossover passages 58, plenum 60, and apertures 62. FIG. 3B additionally illustrates cover plates 64 and holes 66.

Cover plates 64 (also known as an impingement plate) can be comprised of separate plates that are partially set on rib 50 or one single plate that is disposed over forward and aft cavities 48A and 48B to create impingement plenums of cavities 48A and 48B. A plurality of small holes 66 pass through cover plate 64. As is known in the art, impingement plates such as cover plate 64 operate to meter the flow of cooling air to cavities 48A and 48B and cored passages 42 (FIG. 3).

Figure 4:
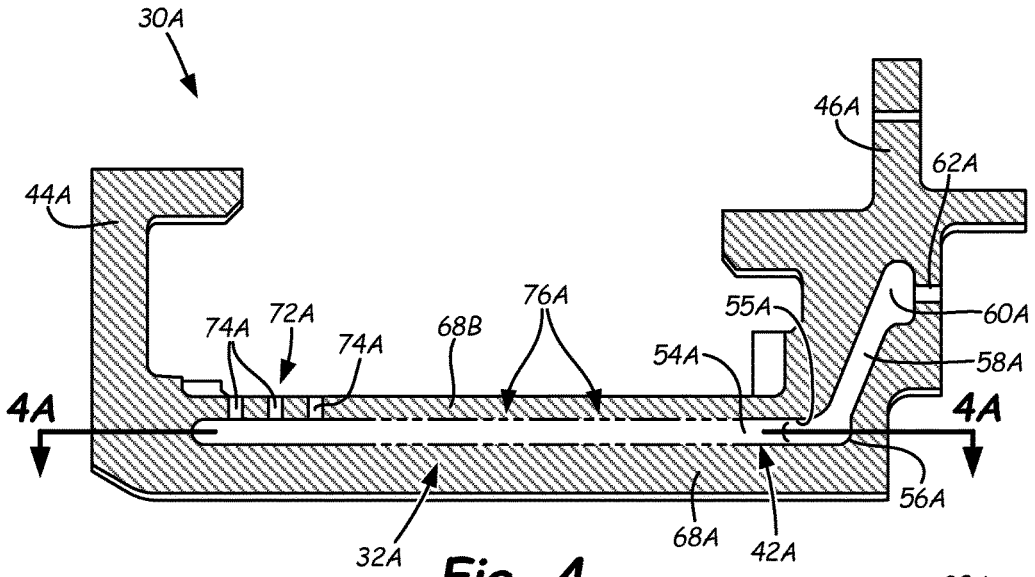
FIG. 4 is a cross-section extending radially through another embodiment of a BOAS.

FIG. 4 illustrates another embodiment of the present invention. FIG. 4 shows a cross-section extending radially through BOAS 30A with respect to engine center line $C_L$ (FIG. 1). BOAS 30A includes wall 32A, cored passages 42A (only one is shown in the section of FIG. 4), forward hook 44A, and aft hook 46A. Wall 32A includes inner diameter portion 68A and outer diameter portion 68B. Each cored passage 42A includes in-line portion 54A with outer diameter surface 55A, trailing edge face 56A, crossover passage 58A, plenum 60A, apertures 62A, impingement zone 72A with cored or drilled holes 74A, and convective zone 76A.

In the embodiment shown in FIG. 4, cored passages 42A are formed between inner diameter portion 68A and outer diameter portion 68B of wall 32A. Thus, cored passages 42A are enclosed in wall 32A for substantially their entire length. Cored passages 42A extend substantially an entire length of the wall 32A from adjacent the forward hook 44A to the aft hook 46A.

In the embodiment described, outer diameter portion 68B adjacent forward hook 44A is configured with impingement zone 72A comprised of a plurality of cored radially extending holes 74A. Impingement zone 72A can be provided with augmentation features in other embodiments. From impingement zone 72A cored passages 42A travel through convection zone 76A to in-line portion 54A.

Figure 4A:
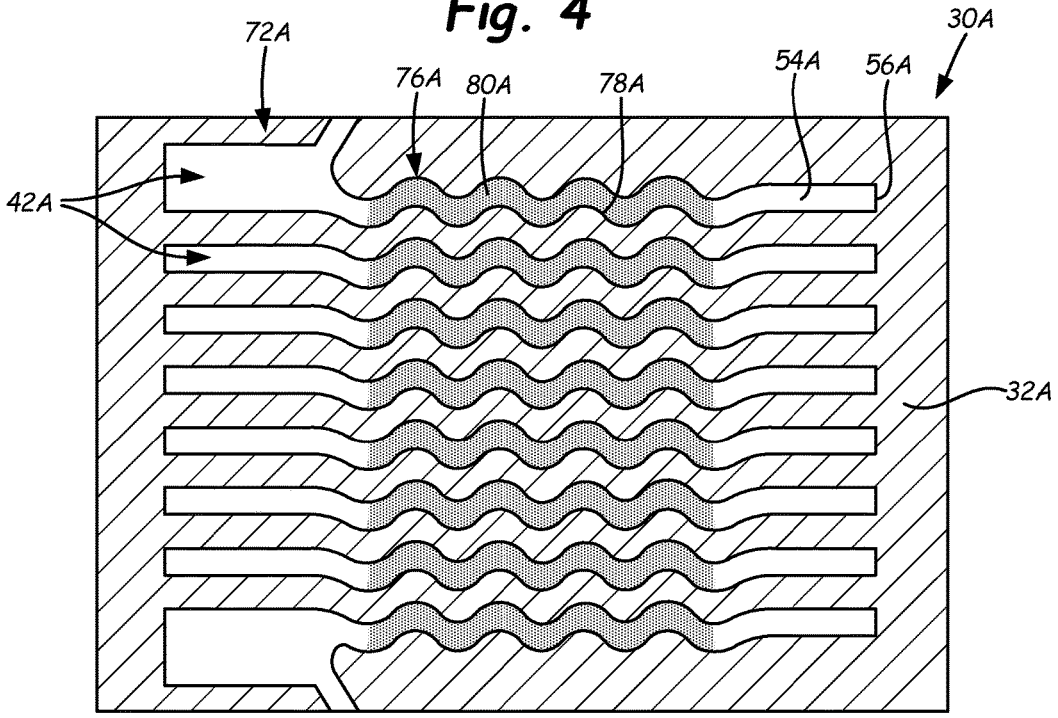
FIG. 4A is a top partial sectional view of the BOAS of FIG. 4 and illustrates cored passages with an impingement zone and convection zone.

FIG. 4A shows a top partial sectional view of BOAS 30A which illustrates various components previously discussed including wall 32A, in-line portion 54A, impingement zone 72A, and convection zone 76A. Additionally, BOAS 30A includes flow turbulator features 78A and augmentation surfaces 80A.

Cored passages 42A allow for flow turbulator features 78A such as sinuously curved lateral walls as shown in FIG. 4A. Such passage geometry was difficult to impossible with drilled passages, and serves to increase the convective coefficient. Augmentation surfaces 80A such as trip strips can additionally be added to surfaces of cored passages 42A. Flow turbulator features 78A and augmentation surfaces 80A are configured to increase convective heat transfer to BOAS 30A from cooling air flow.

Although the embodiment of FIG. 4A is described with both impingement zone 72A and convection zone 76A, in other embodiments BOAS may be provided with only one or neither of these features. In other embodiments, impingement zone may be provided by a cover plate similar to the embodiment of FIG. 3B. A resupply passage can additionally be provided along cored passages as desired.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A blade outer air seal for a gas turbine engine, comprising:

a first wall disposed radially inward from a casing of the gas turbine engine that at least partially defines a first plenum between the casing and the first wall, the first wall comprising:

a forward hook;

an aft hook, wherein the forward and aft hooks are adapted to mount the blade outer air seal to the casing; and a plurality of cored passages, wherein each of the cored passages extends through at least a portion of the first wall adjacent a trailing edge of the blade outer air seal in an axial direction towards the trailing edge and in a radially outward direction towards the casing, and wherein each of the plurality of cored passages are enclosed by the first wall; and a plurality of apertures along the trailing edge of the blade outer air seal, wherein each of the cored passages communicate with the first plenum and at least one of the plurality of apertures to form a flow path therebetween; and a second wall disposed radially inward from the casing and adjacent to the first wall, wherein a second plenum is defined between the second wall and the casing, and wherein the apertures communicate with the second plenum.

2. The blade outer air seal of claim 1, wherein each cored passage comprises:

an inline portion extending axially from a cavity in the first wall to a trailing edge face of the cored passage disposed within the first wall adjacent to the trailing edge of the blade outer air seal; and a crossover passage extending radially outward from an outer diameter surface of the inline portion adjacent to the trailing edge face to the aperture.

3. The blade outer air seal of claim 2, wherein the crossover passage of each core passage communicates with a third plenum that extends laterally through the aft hook, and wherein the third plenum communicates with the plurality of apertures disposed along the trailing edge of the blade outer air seal.

4. The blade outer air seal of claim 1, wherein each cored passage extends substantially an entire length of the first wall from adjacent the forward hook to the aft hook.

5. The blade outer air seal of claim 1, wherein each cored passage has at least one of a convective zone and an impingement zone.

6. The blade outer air seal of claim 5, wherein the impingement zone includes at least one of a plurality of radially extending passages through the first wall and a cover plate with a plurality of radially extending holes therethrough.

7. The blade outer air seal of claim 5, wherein the convective zone of each cored passage has at least one of an augmentation surface and a flow turbulator feature.

8. The blade outer air seal of claim 7, wherein the flow turbulator feature comprises a sinuously curved section of the cored passage.

9. The blade outer air seal of claim 1, wherein each cored passage communicates with a cored cavity within the first wall between the forward hook and the aft hook, and wherein an impingement zone or augmentation surface is disposed within the cored cavity.

10. A gas turbine engine, comprising:

a turbine section comprising:

the blade outer air seal of claim 1;

a rotor blade disposed radially inward of the blade outer air seal; and a stator vane disposed axially adjacent to the rotor blade and the trailing edge of the blade outer air seal, wherein the second wall is an outer platform of the stator vane.

11. The gas turbine engine of claim 10, wherein the turbine section further comprises:

a conformal seal disposed between the trailing edge of the blade outer air seal and the stator vane, and wherein each aperture is disposed radially outward of the conformal seal with respect to a centerline axis of the gas turbine engine.

12. A method of cooling a blade outer air seal comprising:

supplying a cooling medium to a first plenum disposed between the blade outer air seal and an engine casing, wherein the blade outer air seal is disposed radially inward from the engine casing and radially outward from a rotor having a plurality of blades rotatable about an axis;

directing the cooling medium through one or more cored passages within the blade outer air seal to cool the blade outer air seal, wherein directing the cooling medium through one or more cored passages includes:

directing the cooling medium axially towards a trailing edge of the blade outer air seal through an inline portion of the one or more cored passages;

directing the cooling medium from the inline portion radially outward towards the engine casing through a crossover passage; and directing the cooling medium from the crossover passage through an aperture extending through the trailing edge of the blade outer air seal;

directing the cooling medium from the one or more cored passages to a stator vane downstream of the plurality of blades comprising an outer platform disposed radially inward from the engine casing and adjacent to the blade outer air seal, the outer platform defining a second plenum radially between the outer platform and the engine casing; and directing the cooling medium from the aperture to the second plenum.

13. The method of claim 12 and further comprising:

directing the cooling medium received within the second plenum to cool at least a portion of the stator vane.

14. The method of claim 13 and further comprising:

directing a second cooling medium to the second plenum, wherein the second cooling medium has a different source than the cooling medium received by the first plenum.

15. The method of claim 12, wherein the one or more cored passages are enclosed by the blade outer air seal.

16. The method of claim 15, wherein each cored passages has at least one of a convective zone and an impingement zone, and wherein the convective zone has at least one of an augmentation surface and a flow turbulator feature, and wherein the impingement zone includes at least one of a plurality of radially extending passages through the blade outer air seal and a cover plate with a plurality of radially extending holes therethrough.

17. An assembly for a gas turbine engine, the assembly comprising:

a blade outer air seal comprising:

a first wall disposed radially inward from a casing of the gas turbine engine that at least partially defines a first plenum between the casing and the first wall, wherein the first wall extends circumferentially about a centerline axis of the gas turbine engine;

a cavity defined by the first wall that communicates with the first plenum; and a cored passage enclosed within the first wall, wherein the cored passage comprises:

an inline portion extending axially with respect to the centerline axis from the cavity towards a trailing edge of the blade outer air seal, wherein the inline portion terminates at a trailing edge face interior to the first wall;

a crossover passage extending radially outward from the inline portion and extending axially from the inline portion towards the trailing edge of the blade outer air seal; and an aperture extending through the trailing edge of the blade outer air seal and communicating with the crossover passage.

18. The assembly of claim 17, and further comprising:

a second wall disposed radially inward from the casing and adjacent to the trailing edge of the blade outer air seal, wherein a second plenum is defined between the second wall and the casing, and wherein the aperture communicates with the second plenum to form a flow path from the first plenum to the second plenum.

19. The assembly of claim 18, and further comprising:

a conformal seal disposed between the trailing edge of the blade outer air seal and the second wall, wherein the aperture is disposed radially outward of the conformal seal between the casing and the conformal seal.

20. The blade outer air seal of claim 17, wherein the cored passage further comprises:

a trailing edge plenum enclosed within the first wall, wherein the trailing edge plenum communicates between the crossover passage and the aperture.

* * * * *